US009423099B2

(12) United States Patent
Chen

(10) Patent No.: US 9,423,099 B2
(45) Date of Patent: Aug. 23, 2016

(54) LED LAMP HAVING REFLECTOR WITH HIGH HEAT DISSIPATION RATE

(71) Applicant: USTA CO., LTD., Taipei (TW)

(72) Inventor: Chi-Lin Chen, Taipei (TW)

(73) Assignee: USTA CO., LTD., Taipei (TW)

( * ) Notice: Subject to any disclaimer, the term of this patent is extended or adjusted under 35 U.S.C. 154(b) by 110 days.

(21) Appl. No.: 14/499,113

(22) Filed: Sep. 27, 2014

(65) Prior Publication Data

US 2015/0124444 A1 May 7, 2015

(30) Foreign Application Priority Data

Nov. 1, 2013 (TW) ..... 102220362 U

(51) Int. Cl.

| | |
|---|---|
| ***F21S 4/00*** | (2016.01) |
| ***F21V 21/00*** | (2006.01) |
| ***F21V 7/00*** | (2006.01) |
| ***F21V 7/04*** | (2006.01) |
| ***F21V 7/10*** | (2006.01) |
| *F21Y 101/02* | (2006.01) |
| *F21S 8/06* | (2006.01) |
| *F21V 19/00* | (2006.01) |
| *F21V 29/78* | (2015.01) |
| *F21S 6/00* | (2006.01) |
| *F21Y 113/00* | (2016.01) |

(52) U.S. Cl.

CPC ..... *F21V 7/0008* (2013.01); *F21V 7/041* (2013.01); *F21V 7/10* (2013.01); *F21S 6/005* (2013.01); *F21S 8/061* (2013.01); *F21V 19/0055* (2013.01); *F21V 29/78* (2015.01); *F21Y 2101/02* (2013.01); *F21Y 2113/00* (2013.01)

(58) Field of Classification Search

CPC ..... F21V 7/0008; F21V 7/0041; F21V 7/10
USPC ..... 362/249.02, 294, 296.05, 311.02, 362/311.06, 356, 800
See application file for complete search history.

(56) References Cited

U.S. PATENT DOCUMENTS 8,007,135 B2 * 8/2011 Xiang ..... F21S 8/086 362/249.02

* cited by examiner

*Primary Examiner* — Jason Moon Han
(74) *Attorney, Agent, or Firm* — Winston Hsu; Scott Margo

(57) ABSTRACT

A lamp reflector includes a body including a plurality of sheets; a plurality of heat sinks connecting the sheets to form a corn shape; and a plurality of light emitting modules disposed on a surface of the heat sink in such a manner that the light emitting modules face an inner space of the body, wherein each of the light emitting modules includes: a substrate fixed to the surface; and a plurality of light emitting diodes disposed on the substrate and electrically connected to each other by the substrate.

4 Claims, 6 Drawing Sheets

LED LAMP HAVING REFLECTOR WITH HIGH HEAT DISSIPATION RATE

BACKGROUND OF THE INVENTION

1. Field of the Invention

The invention relates to a lamp, and more particularly to a lamp having a reflector with high heat dissipation rate.

2. Description of the Related Art

The luminous efficiency of light emitting diodes (LED) makes largely progress due to improvement of material and technology. Because the luminance of LED is comparable to conventional illuminating devices and LEDs has light weight and long service life, the conventional bulbs are replaced by LEDs.

LEDs are broadly applied to various lamps such as commercial lamps or household lamps. The high power LEDs with high luminance are the first choice of light emitting elements for various lamps. However, the high power LEDs generate high heat which may reduce the service life and performance. Thus, heat dissipation solution become important for lamps using high power LEDs.

Conventional heat dissipation technology for lamps utilizes heat dissipation structure disposed around LEDs to prevent heat from affecting lamps. The heat dissipation structure conducts heat out of the lamps rapidly by means of its highly thermal conductive material. However for wall mounting type lamps or hanging lamps, the design of the heat dissipation structure is limited for the lamp structure and may have a poor heat dissipation effect.

BRIEF SUMMARY OF THE INVENTION

The invention provides a lamp reflector with high heat dissipation rate, wherein several heat sinks are directly disposed on a body of the lamp reflector, and several light emitting modules are directly disposed on the heat sinks to facilitate heat dissipation so as to promote luminous efficiency and extend service life.

The lamp reflector with high heat dissipation rate in accordance with an exemplary embodiment of the invention includes a body including a plurality of sheets; a plurality of heat sinks connecting the sheets to form a corn shape; and a plurality of light emitting modules disposed on a surface of the heat sink in such a manner that the light emitting modules face an inner space of the body, wherein each of the light emitting modules includes: a substrate fixed to the surface; and a plurality of light emitting diodes disposed on the substrate and electrically connected to each other by the substrate.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
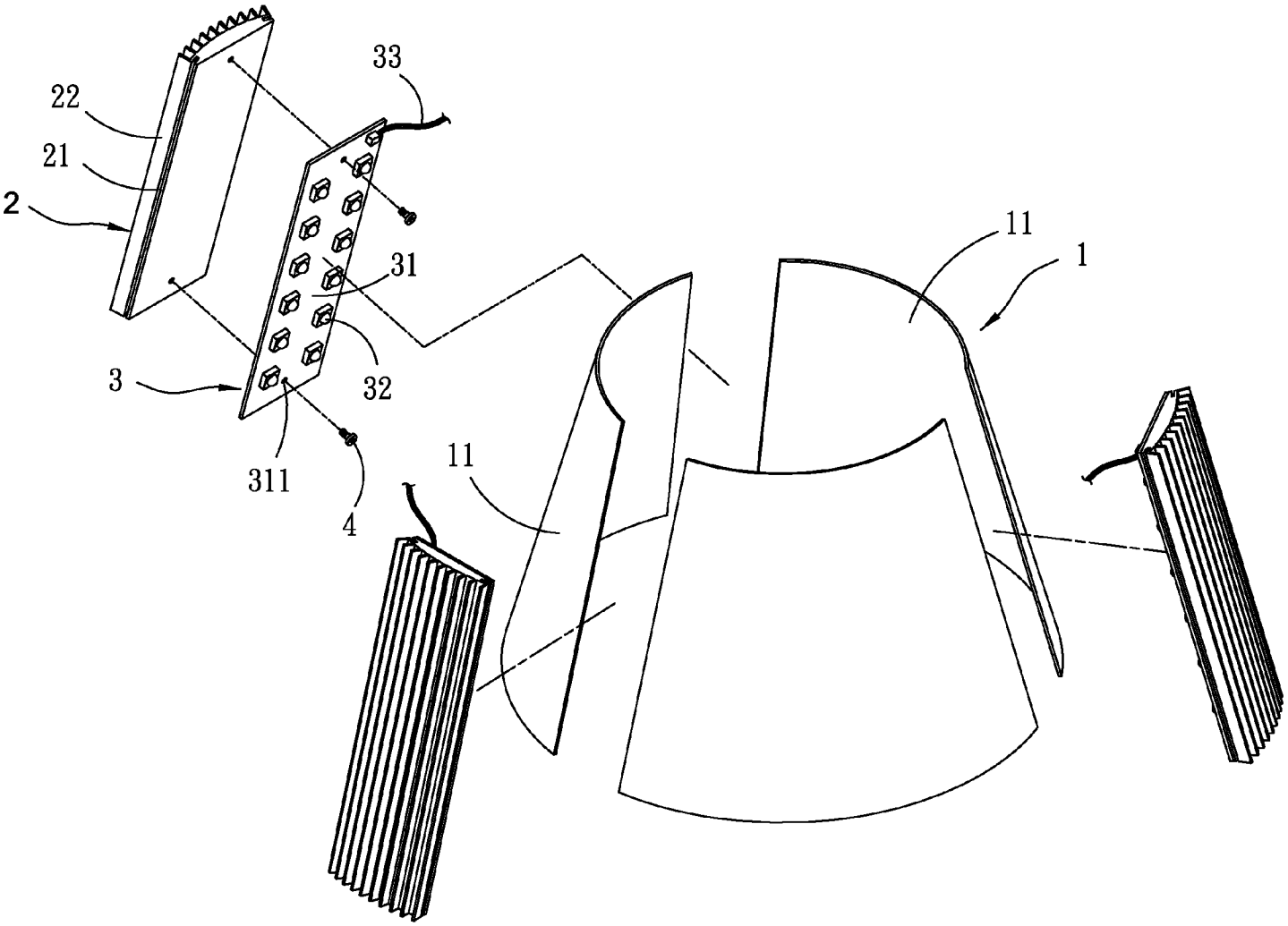
FIG. 1 is a perspective exploded view of an embodiment of a reflector of the invention.
Figure 2:
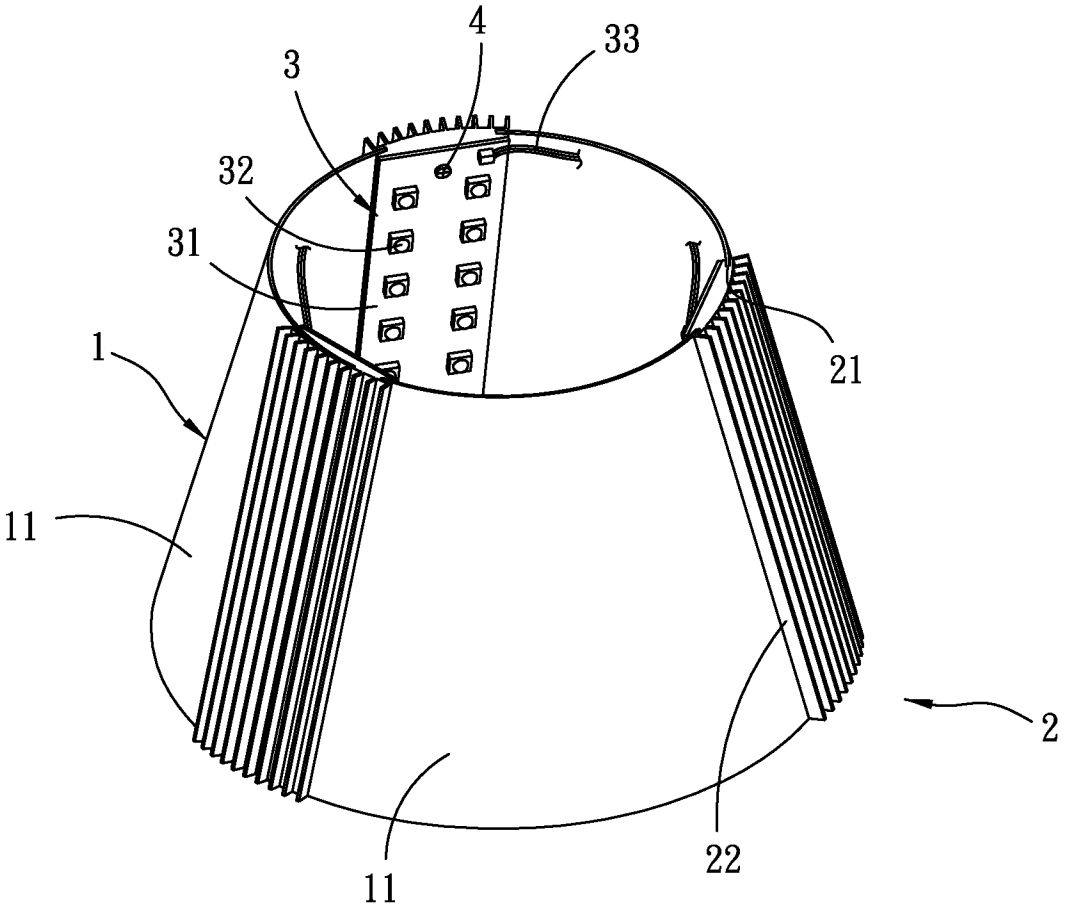
FIG. 2 is a perspective view of an embodiment of a reflector of the invention.
Figure 3:
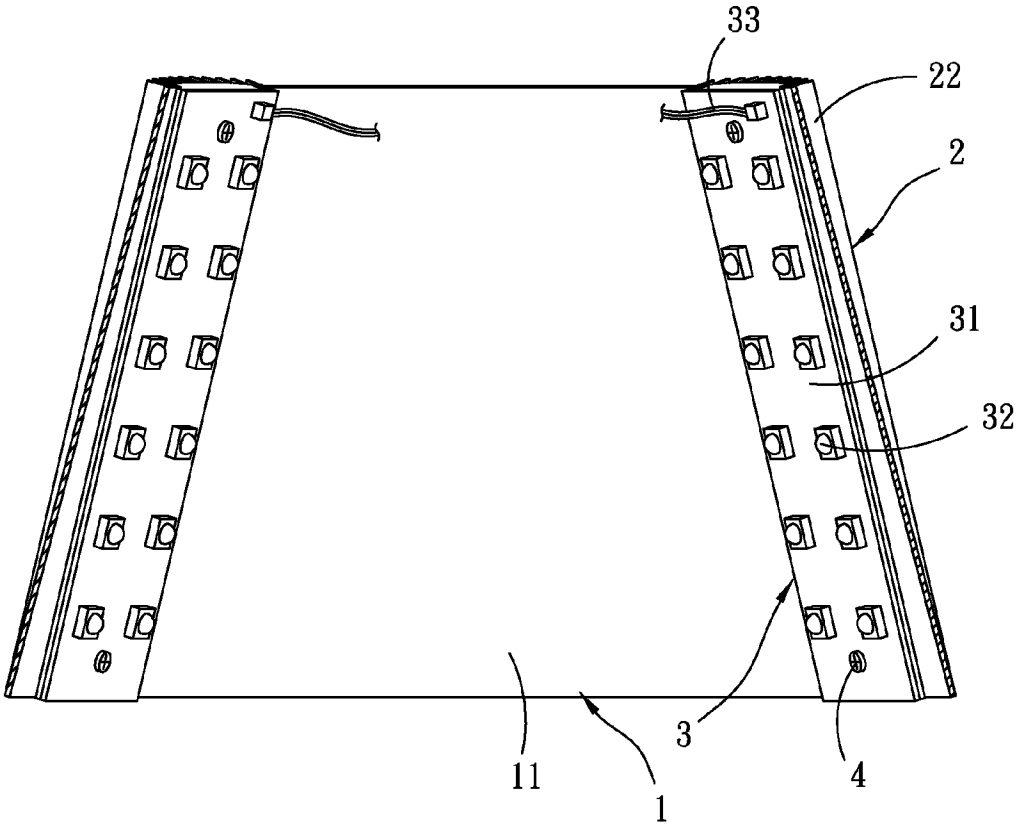
FIG. 3 is a cross section of an embodiment of a reflector of the invention.
Figure 6:
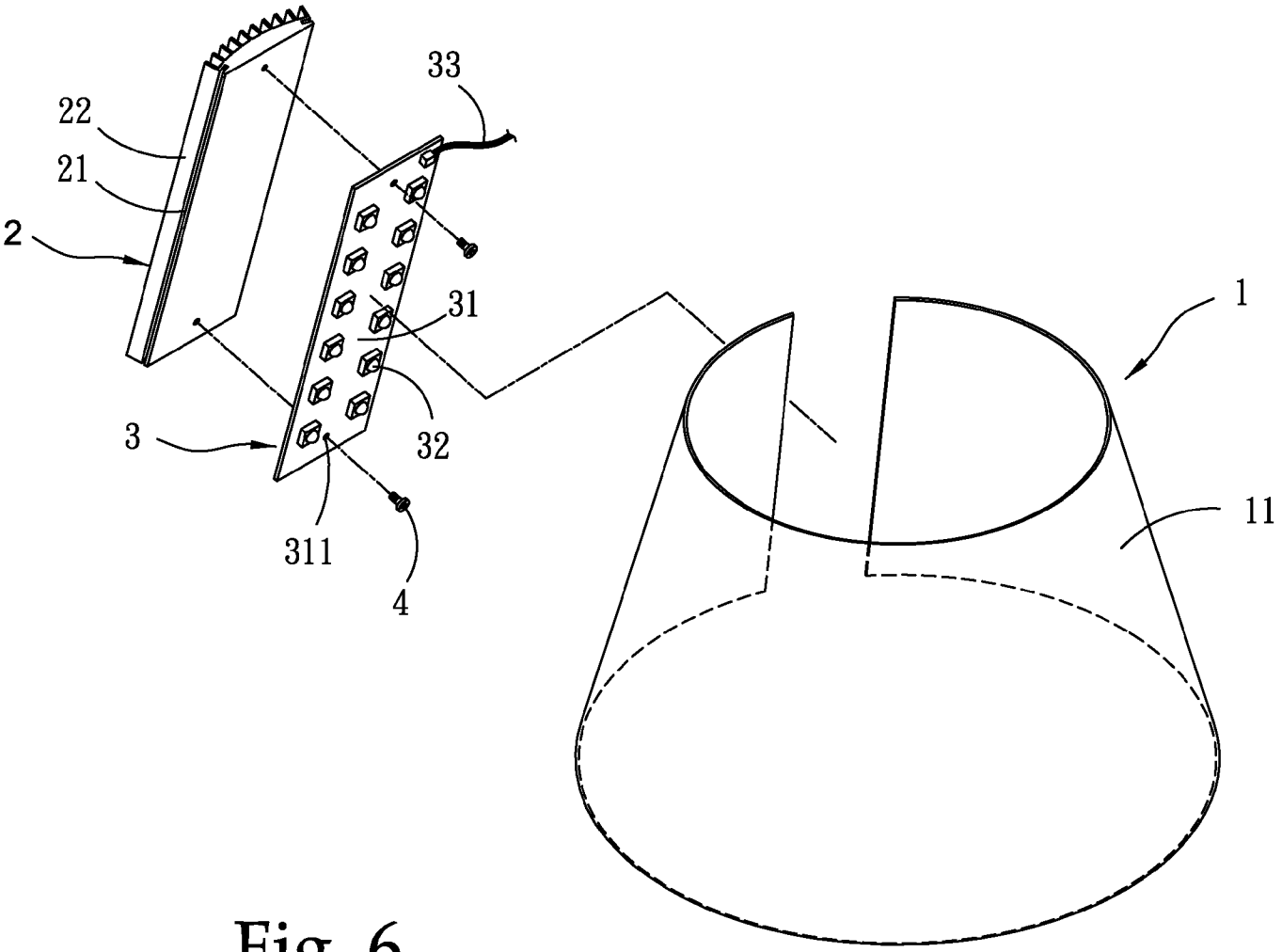
FIG. 6 is a perspective exploded view of another embodiment of a reflector of the invention.

Referring to FIG. 1, a reflector of the invention includes a body 1 including a plurality of sheets 11. In FIG. 6, another embodiment of a reflector of the invention includes only one sheet 11. The sheets 11 are assembled to form a corn shape. The body 1 has an opening formed at top and bottom thereof. A heat sink 2 is disposed between two adjacent sheets 11. In FIG. 6, two lateral sides of the sheet 11 are connected to the heat sink 2. Referring to FIG. 1 again, each heat sink 2 has two lateral sides. A groove 21 is formed on each lateral side of the heat sink 2 respectively. The grooves 21 receive the lateral side of the sheet 11 to join the heat sinks 2 to each sheet 11. A plurality of fins 22 are disposed on a surface of the heat sink 2. A light emitting module 3 is disposed on another surface of each heat sink 2. The light emitting module 3 faces an inner space enclosed by the body 1. The light emitting module 3 includes a substrate 31. In this embodiment, the substrate 31 is a circuit board. Two screw holes 311 are formed near two edges of the heat sink 2 for bolts 4 securing the substrate 31 to the heat sink 2. A plurality of LEDs 32 are disposed on the substrate 31. The LEDs 32 are electrically connected to each other by the substrate 31. The substrate 31 is electrically connected to a lead 33 for each light emitting module 3 electrically connected to a power supply to emit light as shown in FIG. 3. Heat generated by the LEDs 32 is conducted to the heat sink 2 through the substrate 31 and further transfers to air through the fins 22 disposed on the heat sink 2, whereby the heat is avoided to accumulate on the LEDs 32. FIG. 2 shows the assembly of the reflector.

Figure 4:
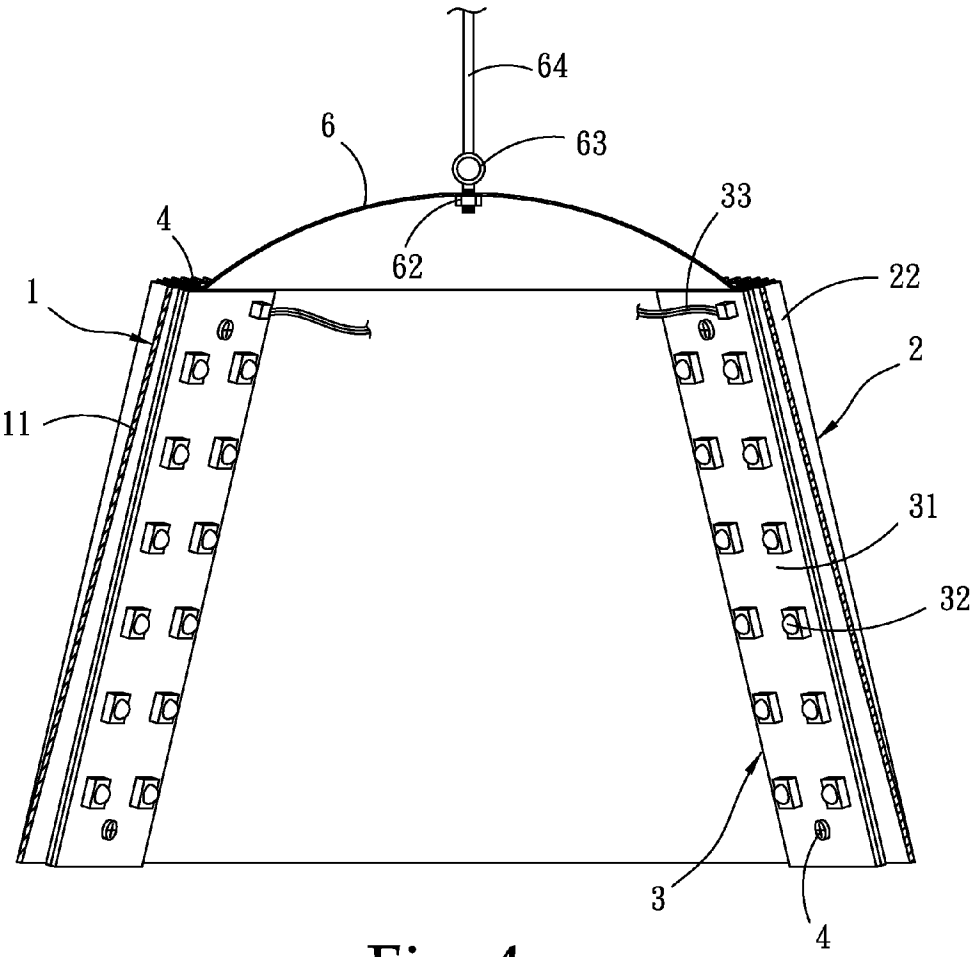
FIG. 4 is a cross section of an embodiment of a lamp of the invention.

Referring to FIG. 4, the reflector of the invention is hung in a room. A top of the body 1 is connected to a circular plate 6 which is secured to an outer periphery of the top of the body 1 by several bolts 4. A ring 63 is fixed to at the center of the circular plate 6 by a bolt 62. The ring 63 is connected to a connecting member 64. In this embodiment, the connecting member 64 is a wire. The connecting member 64 hangs the reflector in the air. The LEDs 32 emit light for illumination of the room.

Figure 5:
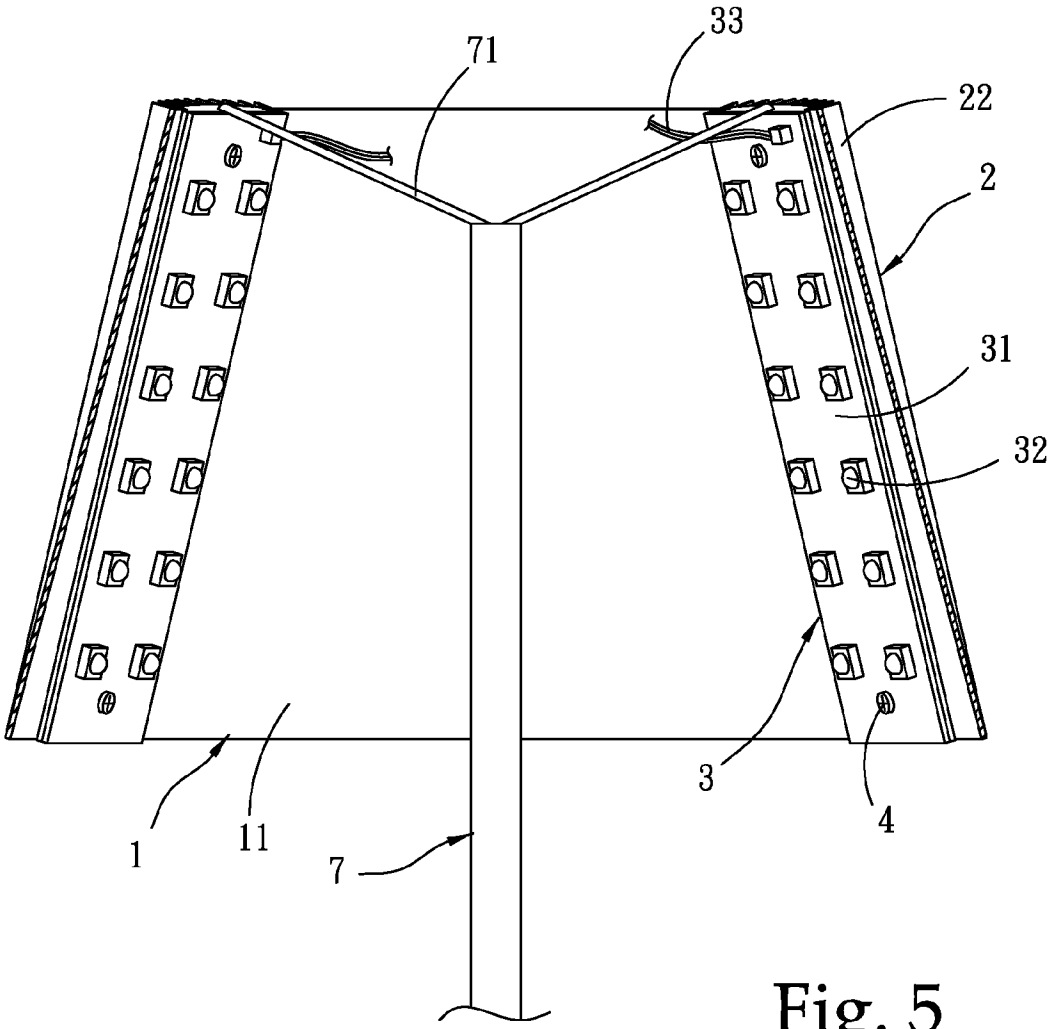
FIG. 5 is a cross section of another embodiment of a lamp of the invention.

Referring to FIG. 5, a rod 7 extends to the reflector, and several supporting arms 71 connecting the body 1 and the rod 7 to prop up the reflector. The LEDs 32 emit light for illumination of the room.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A LED reflector with high heat dissipation rate, comprising:

a body comprising a sheet;

a heat sink connected to two ends of the sheet to form a cone shape;

a light emitting module disposed on a surface of the heat sink in such a manner that the light emitting module faces an inner space of the body, wherein the light emitting modules comprises:

a substrate fixed to the surface; and a plurality of light emitting diodes disposed on the substrate and electrically connected to each other by the substrate.

2. The LED reflector with high heat dissipation rate as claimed in claim 1, wherein the heat sink has two lateral sides, and a groove is formed on each of the lateral sides respectively.

3. The LED reflector with high heat dissipation rate as claimed in claim 1, wherein the heat sink has a plurality of fins on another surface thereof.

4. The LED reflector with high heat dissipation rate as claimed in claim 1, wherein the substrate is electrically connected to a lead.

* * * * *